United States Patent [19]

Wellman

[11] 4,057,210

[45] Nov. 8, 1977

[54] ARTICLE HOLDING DOUBLE-SLING KIT

[76] Inventor: Lester R. Wellman, 110 Lakewood Place, Highland Park, Ill. 60035

[21] Appl. No.: 709,381

[22] Filed: July 28, 1976

[51] Int. Cl.[2] ..... F16M 13/00

[52] U.S. Cl. ..... 248/318; 24/129 B; 24/257; 47/67; 206/820; D6/113

[58] Field of Search ..... 248/318, 317, 320, 321; 224/49; 206/820; 47/67; D6/113; 24/115 G, 129 B, 257

[56] References Cited

U.S. PATENT DOCUMENTS

| | | | |
|---|---|---|---|
| 356,578 | 1/1887 | Durling | 24/129 B |
| 363,352 | 5/1887 | Avery | 24/129 B |
| 562,566 | 6/1896 | Baynes | 24/257 R |
| 941,448 | 11/1909 | Haglund | 248/318 |
| 2,532,306 | 12/1950 | Herbert | 224/49 |
| 3,016,136 | 1/1962 | Poupitch | 206/820 |
| 3,402,910 | 9/1968 | Purvis | 248/318 |
| 3,494,583 | 2/1970 | Parr | 24/257 R |
| 3,505,921 | 4/1970 | Wigam | 85/72 |

FOREIGN PATENT DOCUMENTS

| | | | |
|---|---|---|---|
| 521,890 | 8/1953 | Belgium | 248/318 |

*Primary Examiner*—Marion Parsons, Jr.
*Attorney, Agent, or Firm*—Robert W. Erickson

[57] ABSTRACT

An article-holding, double-sling kit comprising four strips of thin, flexible material. Each one of a longer pair of strips contains a plurality of apertures along its entire length and through which hanging line is interlaced. One of these longer strips contains at least two parallel slots, proximate its center, through which the second is interwoven in crossed configuration. These strips are flexible in one direction and substantially rigid in the 90°-opposite direction. Of the second pair of strips, shorter than the first pair, each containing a plurality of apertures, a first is foldable upon itself and serves as a slide to gather the double-sling hanging lines proximate to the article; the second shorter strip functions as a cleat through the apertures of which the four ends of line are reversibly interlaced to form a hanging loop. The article is centered at the junction of the cross and the weight thereof causes the longer strips to conform substantially to the outer surface of the article to be suspended.

6 Claims, 5 Drawing Figures

Fig. 1
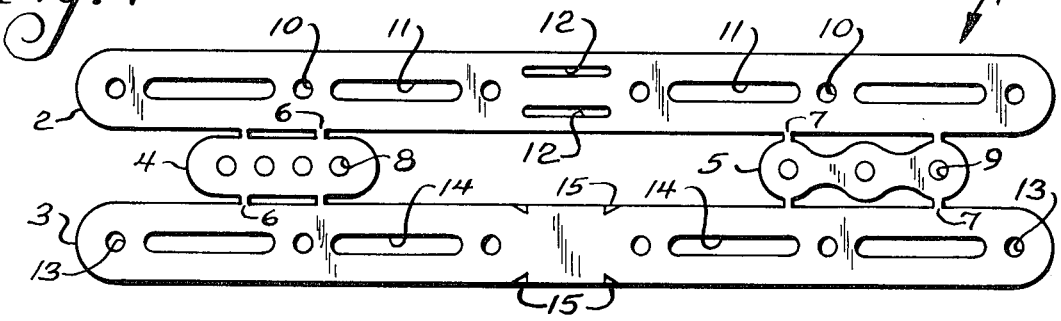
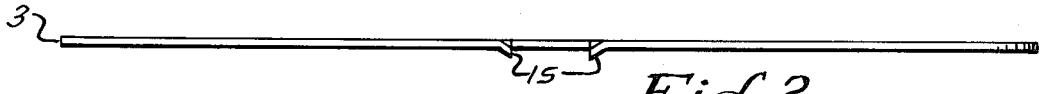
Fig. 2
Fig. 3
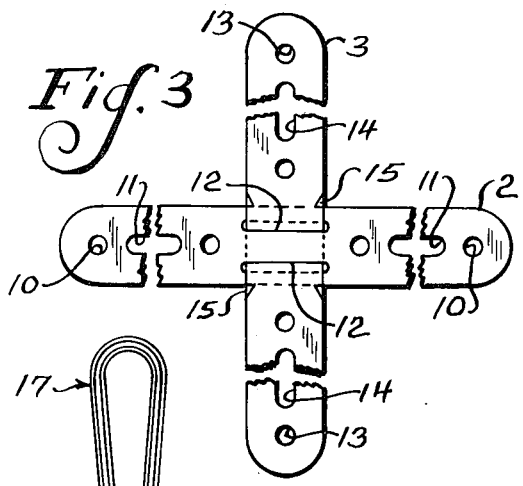
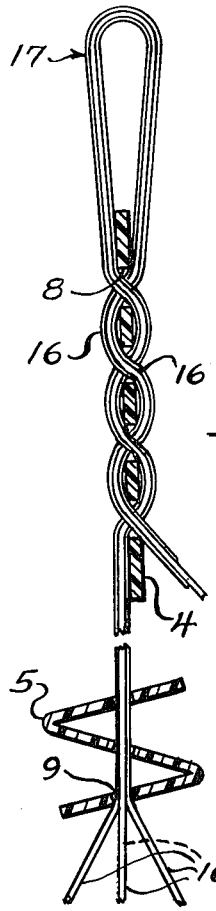
Fig. 4
Fig. 5
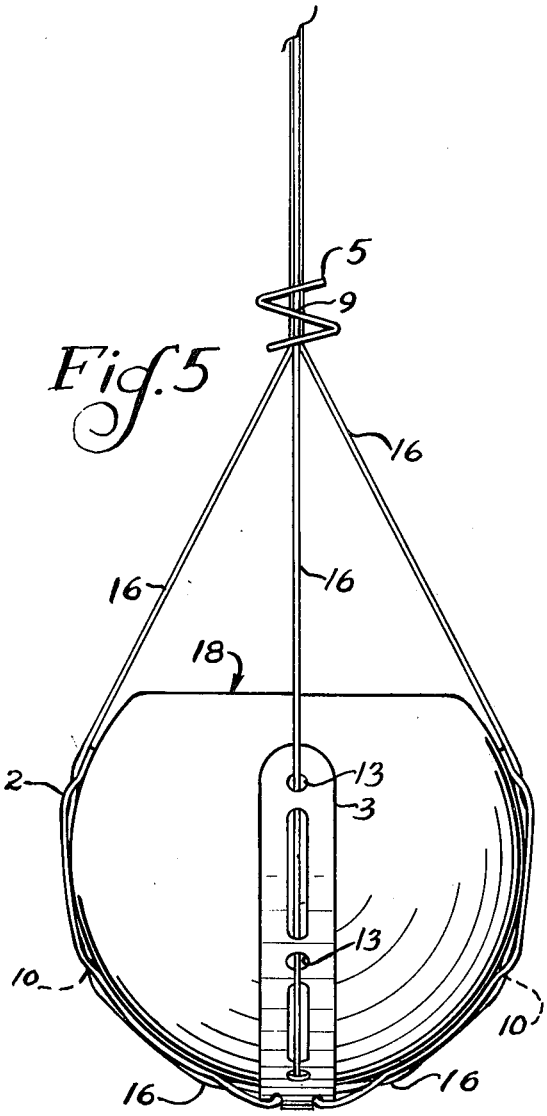

ARTICLE HOLDING DOUBLE-SLING KIT

APPLICABILITY OF INVENTION

The invention herein described is applicable to the popular technique of suspending, or hanging articles in mid-air as contrasted to the practice of using table-tops, stands, etc. More specifically, my inventive concept is directed toward an article-holding, or suspending kit which is easily assembled into its functional state, and which affords advantages heretofore unavailable. The double-sling, when assembled, can be employed to suspend articles from ceilings, or other horizontal surfaces, or a finite distance away from vertical walls.

Heretofore, article-holding, or hanging devices have been fabricated from a multitude of strands of string, rope, yarn, etc. These have been woven and knotted — i.e. via macrame, crocheting, simple twisting and braiding, etc. — to provide a variety of designs, all of which have a lower area for receiving and holding the article, as well as a knotted junction where the hanging lines are brought together to form a single-like strand which terminates in a knotted loop to be placed over the hook from which the article is suspended. In addition to the sheer bulk of such devices, there are other attendant disadvantages which are readily overcome by the article-holding, double-sling encompassed by the present invention concept. One such other disadvantage involves the stability of the article after being suspended by the common devices above-described. Other disadvantages of prior devices, as well as the advantages of the present double-sling kit are hereafter set forth. The double-sling kit can be employed with a variety of articles including, but not by way of limitation, small toys, ornaments, terrariums, vases, globes, lamps, floating candles, potted plants and other foliage, etc.

OBJECTS AND EMBODIMENTS

A principal object of my invention is to provide a double-sling kit which facilitates the construction of a device for suspending various articles. A corollary objective resides in an article-holding device which affords greater stability, with respect to maintaining the article in its suspended state, by providing equal spacing of the hanging lines.

Another object is to provide a device which is transparent and not readily discernible when serving its intended function. A specific object involves a saving of both time and expense in hanging, or suspending various articles, and especially plant-containing receptacles.

In one embodiment, my inventive concept encompasses an article-holding kit which comprises: (a) a first pair of elongated strips, each of which contains a plurality of apertures along its length, a first one of which having at least two parallel slots proximate to the center thereof, said slots adapted to receive, in crossed configuration, the second of said strips; and, (b) a second pair of shorter, elongated strips, each of which contains a plurality of apertures along its length, and one of which is foldable upon itself whereby the apertures therein are aligned.

In another embodiment, the second strip of said first pair contains a plurality of off-sets (i) proximate to the center thereof and, (ii) which abut the edges of said first strip when the strips are interlaced in latched, crossed configuration.

A more specific embodiment of my invention is directed toward a unitary article-holding kit which comprises, in coplanar relationship: (a) a first pair of separated, elongated strips, each of which contains a plurality of apertures along its length, a first one of which having at least two parallel slots proximate to the center thereof, said slots adapted to receive, in crossed configuration, the second of said strips; and, (b) a second pair of shorter, elongated strips, each of which contains a plurality of apertures along its length, and which (i) are removably connected to said first pair of strips along the edges thereof and, (ii) one of which shorter strips being foldable upon itself whereby the apertures therein are aligned.

Other objects and embodiments of the article-holding, double-sling kit, encompassed by the present invention, will become evident from the following more detailed description thereof. In one such other embodiment, each of the first pair of strips contains elongated slots which are intermediate the apertures and preferably in alignment therewith. Additionally, it is preferred that one of the shorter strips have at least two intermediate areas of narrower width by which the user can ascertain the loci at which it is foldable upon itself.

SUMMARY OF INVENTION

Current article-suspending devices, as previously described, are generally woven, with knots in appropriate places, from a multiplicity of strands of line such as cord, rope, string or yarn. These are obtained by the ultimate user in finished form; of course, the user can, with sufficient skill, expend the time in fabricating his own. Such hanging, or suspending devices are, however, not without disadvantages, both practical and aesthetic. In addition to expense and/or time, there exists the difficulty associated with insufficient stability as a result of which, the article, once installed, is subject to slippage between the hanging lines. Usually, the pre-fabricated hangers are either too large, or too small, and do not blend with a given color scheme. Some hanging devices are currently being marketed in the form of a square, disc, hexagon, etc. upon which the bottom of the planter rests. These are supplied with holes, or apertures (1) in the corners if square, (2) circumferentially and 90 ° apart if a disc, or (3) at each apex if hexagonal. Additional apertures may be provided through the interior surface such that the hanging lines may be interlaced. With such devices, sufficient vertical support (around the outer surface of the article) is lacking to the extent that the installed planter is laterally unstable due to unequal spacing of the hanging lines; this is especially the situation with the heavier potted plants and other foliage. Furthermore, with respect to potted plants, there is present the problem of installing the pre-planted receptacle in the designated area without injury to the planted foliage.

The foregoing disadvantages and problems associated with the current article hanging devices are overcome and readily solved through the device encompassed by the invention herein described. Since its initial form is that of a simple kit, which will accommodate articles of various sizes and shapes, and can be easily fabricated in a variety of sizes, the purchaser and ultimate user can select the most appropriate size for the article to be suspended.

While applicable to the technique of suspending a wide variety of articles, the further description of the present double-sling kit will be directed toward its use with planted foliage, but not with the intent to so limit the same. As hereinafter set forth, it is possible to construct the device around a plant-containing receptacle with minimal risk of damage to the foliage. Furthermore, the problems associated with instability are eliminated by virtue of the fact that firm, evenly-spaced (uniform) vertical support around the external surface of the article is provided. As compared to the cord- or yarn-fabricated planter, manufacturing is considerably less difficult and expensive. Also, the untimate user requires only a few minutes time to assemble the double-sling into its functional state with the planter and foliage in position. From the aesthetic viewpoint, the material of construction can be clear and, depending upon the user's selection, colored, translucent or opaque.

Basically, the double-sling kit comprises four thin, elongated strips of material such as polyethylene, polyacetate, polyesters, and other polymerized substances; polyvinyl chloride is particularly preferred. Also, although not essential, all four strips are preferentially made from the same material. One pair of the strips are substantially longer than the other pair and are preferably the same length and width. Both of the longer strips contain a plurality of apertures along their length, and at least one at each end thereof. The precise number of apertures, which guide the supporting lines, is primarily dependent upon the length of the strip. An even number, and more than two apertures per elongated strip is preferred. The plurality of apertures are employed to interlace the hanging line along the entire length of each strip; the even number thereof allows the two ends of the hanging line to emanate, or come through the same side of the strip. It is within the scope of the present invention to supply hanging line with the kit; this may be a single strand which the user cuts in half, or two strands, one for each of the perforated longer strips. The hanging line can be clear, or colored; material of fabrication can be substantially invisible threads of polyvinyl chloride, or other polymeric substance. Preferred is a material which is both thin and strong, such as monofilament fishing line. Each of the longer strips also preferably contains elongated slots which are disposed intermediate the apertures and in direct alignment therewith. These slots serve to increase the flexible nature of the strips, tend to make them less discernible and result in more surface contact with the planter in view of the fact that the interlaced hanging line will nest therein.

One of the longer strips has at least two parallel slots proximate to the center and preferably also parallel to the edges of the strip. These are sufficient in length to accept the width of the second longer strip which is woven therethrough in crossed configuration. Where the centrally-disposed slots are also parallel to the edges of the strip, the configuration will be that of a 90° cross. In order to increase the stability of the double-sling, the second longer strip contains off-sets, or swages proximate to the center thereof. The off-sets are disposed at the edges of the second strip and thus abut the edges of the first strip when the former is interwoven through the centrally-disposed parallel slots of the latter, thereby forming a relatively immovable and stable cross. Crossing these longer strips in this manner allows flexible conformation, with the exterior surface of the suspended article, in one direction only and resists displacement in a direction 90° therefrom.

The second pair of strips are shorter than the first pair which serve as the receptacle for the planter; however, they also contain a plurality of apertures along the length thereof. The first of the shorter strips serves as a cleat through the apertures of which the ends of the hanging line are reversibly interlaced. The line is effectively trapped thereby, but is removable should the need arise; a loop, by which the planter is suspended, is formed as a result of reversing the lines through the apertures in the cleat. The second shorter strip is intended to serve as a slide for creating a junction where the hanging lines converge to form a quasi-single strand. This strip may be non-uniform with respect to its width, having at least one narrower area intermediate wider areas. Preferably, there are at least two such narrower areas, and the apertures are disposed in the areas of greater width. The intermediate areas of narrower width facilitate folding this shorter strip upon itself to form the slide. As an alternative, this shorter strip may be scored intermediate its apertures to facilitate folding such that the apertures become aligned to receive the ends of the hanging lines.

As previously stated, the four strips can be fabricated from any suitable material which possesses sufficient flexibility at a thickness of about ten to about twenty mils. A particularly preferred material is polyvinyl chloride which possesses a high degree of durability. It also lends itself readily to die cutting, molding, or stamping. The four strips can be manufactured as individual pieces, one of each comprising the kit. As hereinafter illustrated, however, the kit is preferably unitary in its construction, with the four strips being in coplaner relationship. In a preferred embodiment, the shorter strips are disposed intermediate the longer strips and removably connected along the edges thereof by relatively narrow tabs which are easily severed to separate the pieces. The precise length and width of each of the four strips is not essential and will be determined by the size of the planter. However, the longer strips should have a length which is greater than the largest dimension of the bottom of the planter.

To assemble the double-sling planter hanger from a unitary kit, the connecting tabs are cut and the resulting burrs trimmed. The two longer pieces are connected by weaving the first strip through the centrally-disposed parallel slots of the second; since the first strip contains off-sets which then abut the edges of the second strip when woven such that the off-sets are downwardly engaged, the two are effectively latched in crossed configuration. A hanging line is then laced through the apertures along the length of each strip and the planter centered at the junction of the cross. The slide is folded upon itself and the four ends of the hanging lines are threaded through the holes therein, and then laced, as a quasi-single strip, through the holes in the cleat. A loop is formed above the cleat and the four ends are reversibly laced through the holes. As the hanger is raised to the hook from which it will be suspended, the weight of the planter causes the longer strips to contact (substantially vertically) the outer surface of the article, and correctly positions the hanging lines.

Further description of my invention will be made in conjunction with the accompanying drawing. It is believed that the Figures, in view of the foregoing discussion, will provide a clear understanding of the present double-sling kit and its function.

BRIEF DESCRIPTION OF THE DRAWING

The double-sling article-holding kit of the present invention is represented by the various views illustrated in the drawings. Since these are presented for the sole purpose of illustration and further edification, they are not to be construed as drawn precisely to scale.

FIG. 1 is a plan view of the double-sling kit 1 unitarily fabricated with the four strips disposed in coplaner relationship.

FIG. 2 is an elevation of the edge of strip 3 indicating the location of swages, or offsets 15.

FIG. 3 is a broken plan view illustrating the means by which the two longer strips 2 and 3 are woven and connected through parallel slots 12.

FIG. 4 is a partially-sectioned view to show the relationship of slide 5 to the hanging lines 16, and the manner in which the latter are reversibly laced through clear 4 to form a hanging loop 17.

FIG. 5 is an elevation of a portion of the hanger with a planting receptacle 18 in place.

DETAILED DESCRIPTION OF DRAWING

With specific reference now to the accompanying drawing, the preferred unitary construction of the kit 1 is shown in FIG. 1. The longer strips 2 and 3 are separated by the shorter strips 4 and 5 in coplanar relation thereto. Relatively narrow tabs 6 and 7 connect the four individual strips, and are easily cut, or otherwise severed, to separate the same. Strip 2 has a plurality of apertures, or holes 10 disposed along its length; intermediate these apertures are a series of elongated slots 11. Likewise, strip 3 has alternating apertures 13 and slots 14 distributed along its length. As shown in FIG. 5, hanging lines 16 are laced, one each through apertures 10 and 13; where the lines are between the planter 18 and strips 2 and 3, they will nest in elongated slots 11 and 13 to permit greater surface contact of the strips with the planter. FIG. 1 also shows the centrally-disposed parallel slots 12 in strip 2, and four off-sets 15 at the edges of strip 3. The detent state of these off-sets is illustrated in FIG. 2. Shorter strip 4, which serves as the cleat, contains a plurality of apertures 8 through which the hanging lines 16 are reversibly laced to form a hanging loop 17. Shorter strip 5, which functions as a slide to gather the hanging lines into a quasi-single strand, contains apertures 9; strip 5 is foldable upon itself at the intermediate narrow widths to form a zig-zag, or "S" shaped slide, with the apertures aligned to accept hanging lines 16.

FIG. 3 is a plan view showing the crossed configuration when strip 3, containing off-sets 15, is woven through the parallel slots 12 which are centrally-disposed in strip 2. When the pieces of hanging line are laced through apertures 10 and 13, it is preferred that no portion thereof appear atop the junction of the cross upon which planter 18 rests. After strips 2 and 3 have been connected and the hanging lines laced the plant-containing receptable 18 is placed on the junction of the cross, and lines 16 are gathered together and threaded through holes 9 in the folded slide 5, as shown in FIG. 4. The quasi-single strand is then laced through holes 8 in cleat 4, loop 17 is formed and the strand 16 reversibly laced through holes 8.

FIG. 5 is an elevation of a portion of the planter hanger indicating the disposition of planter 18 therein and the function of zig-zag slide 5 in gathering the four lines 16 (one is hidden in this view) into the quasi-single strand. It should be noted that strips 2 and 3 conform substantially to the outer shape of planter 18 and that the nesting of lines 16 within elongated slots 11 and 14 affords increased areas of contact between the strips and the planter.

The foregoing specification, particularly when read in light of the accompanying drawing, is believed to present a concise definition and clear understanding of the planter hanging kit of the present invention, the scope and spirit of which is defined in the appended claims.

I claim as my invention:

1. An article-holding kit which comprises:
   a. a first pair of elongated strips, each of which contains (i) a plurality of apertures along its length and, (ii) elongated slots intermediate said apertures and in alignment therewith, a first one of said strips having at least two parallel slots proximate to the center thereof, said slots adapted to receive, in crossed configuration, the second of said strips which contains at least two off-sets on each edge (i) proximate to the center thereof and, (ii) which abut the edges off said first strip when the strips are interlaced in latched, cross configuration; and,
   b. a second pair of shorter, elongated strips, each of which contains a plurality of apertures along its length, and one of which is foldable upon itself, whereby the apertures therein are aligned.

2. The article-holding kit of claim 1 further characterized in that said foldable shorter strip contains at least two intermediate areas of narrower width.

3. The article-holding kit of claim 1 further characterized in that said first pair of strips is flexible in one direction and rigid in the direction 90° thereto.

4. A unitary article-holding kit which comprises, in coplanar relationship:
   a. a first pair of separated, elongated strips, each of which contains (i) a plurality of apertures along its length and, (ii) elongated slots intermediate said apertures and in alignment therewith, a first one of said strips having at least two parallel slots proximate to the center thereof, said slots adapted to receive, in crossed configuration, the second of said strips which contains at least two off-sets on each edge (i) proximate to the center thereof and, (ii) which abut the edges of said first strip when the strips are interlaced in latched, cross configuration; and,
   b. a second pair of shorter, elongated strips, each of which contains a plurality of apertures along its length, and which (i) are removably connected to said first pair of strips along the edges thereof and, (ii) one of which shorter strips being foldable upon itself whereby the apertures therein are aligned.

5. The article-holding kit of claim 4 further characterized in that said second pair of shorter strips are disposed between said first pair of strips.

6. The article-holding kit of claim 4 further characterized in that said foldable shorter strip contains at least two intermediate areas of narrower width.

* * * * *